United States Patent [19]

Suganuma et al.

[11] 4,388,114

[45] Jun. 14, 1983

[54] ANTI-WEAR SINTERED ALLOY

[75] Inventors: Tetsuya Suganuma, Nagoya; Yoshio Fuwa, Toyota; Shuichi Fujita, Toyota; Takahashij Yoshitaka, Toyota, all of Japan

[73] Assignee: Toyota Jidosha Kogyo Kabushiki Kaisha, Aichi, Japan

[21] Appl. No.: 213,239

[22] Filed: Dec. 5, 1980

[30] Foreign Application Priority Data

Mar. 4, 1980 [JP] Japan ..... 55-27107

[51] Int. Cl.[3] ..... C22C 38/02; C22C 38/04; C22C 38/20; C22C 38/36

[52] U.S. Cl. ..... 75/243; 75/230

[58] Field of Search ..... 75/230, 243

[56] References Cited

U.S. PATENT DOCUMENTS

| | | | |
|---|---|---|---|
| 4,236,923 | 12/1980 | Takahashi et al. | 75/208 R |
| 4,265,388 | 5/1981 | Takahashi et al. | 228/135 |
| 4,268,309 | 5/1981 | Serino et al. | 75/230 |

FOREIGN PATENT DOCUMENTS

| | | | |
|---|---|---|---|
| 655953 | of 1938 | Fed. Rep. of Germany . | |
| 2336241 | of 1975 | Fed. Rep. of Germany . | |
| 2819310 | 11/1978 | Fed. Rep. of Germany | 75/243 |
| 7330201 | of 0000 | Fed. Rep. of Germany . | |
| 54-62108 | 6/1979 | Japan . | |
| 54-126623 | 9/1979 | Japan . | |
| 55-113805 | 9/1980 | Japan . | |
| 55-142452 | 11/1980 | Japan . | |
| 55-145151 | 11/1980 | Japan . | |
| 55-145156 | 11/1980 | Japan . | |
| 628679 | of 0000 | United Kingdom . | |
| 1580689 | 12/1980 | United Kingdom | 75/243 |

OTHER PUBLICATIONS

F. Eisenkolf, "Die Neurere Entwicklung der Pulvermetallurgie" 1955, p. 454.

Kieffer/Hotop, "Sintereisen und Sinterstahl" 1948, pp. 177–180.

*Primary Examiner*—Mark Bell

*Attorney, Agent, or Firm*—Oblon, Fisher, Spivak, McClelland & Maier

[57] ABSTRACT

An anti-wear sintered alloy comprising chrome 2.5–7.5 weight %, manganese 0.10–3.0 weight %, phosphorus 0.2–0.8 weight %, copper 1.0–5.0 weight %, silicon 0.5–2.0 weight %, molybdenum 0–3 weight %, and carbon 1.5–3.5 weight %, the balance being Fe and less than 2% impurities, and a process of manufacturing therefore.

12 Claims, 2 Drawing Figures

ANTI-WEAR SINTERED ALLOY

BACKGROUND OF THE INVENTION

1. Field of the Invention

The present invention relates to a high-density, high-hardness, anti-wear sintered alloy characterized by excellent durability when used in a slidable part subjected in service to a relatively high plane pressure.

2. Description of the Prior Art

Slidable parts are often required to operate at relatively high plane pressures in applications such as cams in an internal combustion engine. Under such severe conditions, lubricants are usually unstable. As a result, conventional surface treated materials such as heat-treated, chilled cast, chrome-plated or soft nitrided steel tend to deteriorate due to excessive wear, scuffing or pitting. There is an increasing demand for highly durable materials free from these problems.

Sintered alloys are universally recognized as highly wear-resistant materials for slidable parts and they find numerous practical applications. It has been difficult, however, to obtain high-density, high-hardness materials by conventional mass production systems, making post-treatment such as forging or heat treating necessary. It has heretofore been impossible to produce conveniently and at low cost materials for slidable parts which are sufficiently durable under severe working conditions.

The need continues to exist, therefore, for a highly durable sintered alloy characterized by superior resistance to wear, scuffing or pitting when used in slidable parts subjected to a relatively high plane pressure and for a method of mass-producing such materials economically by conventional manufacturing procedures.

SUMMARY OF THE INVENTION

The primary object of the present invention is to provide a high-durability, high-density, high-hardness anti-wear sintered alloy with superior resistance to wear, scuffing and pitting when used in slidable parts.

Another object of the present invention is to provide a sintered alloy as described above by a manufacturing process amenable to mass production.

These and other objects have been attained by providing a high-durability, high-density, high-hardness anti-wear sintered alloy containing Cr 2.5–7.5 wt. %, Mn 0.10–3.0 wt. %, P 0.2–0.8 wt. %, Cu 1.0–5.0 wt. %, Si 0.5–2.0 wt. %, Mo 0–3 wt. %, C 1.5–3.5 wt. %, and less than 2% impurities, the balance being Fe, and a manufacturing process therefor.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings wherein.

DETAILED DESCRIPTION OF THE INVENTION

Figure 1:
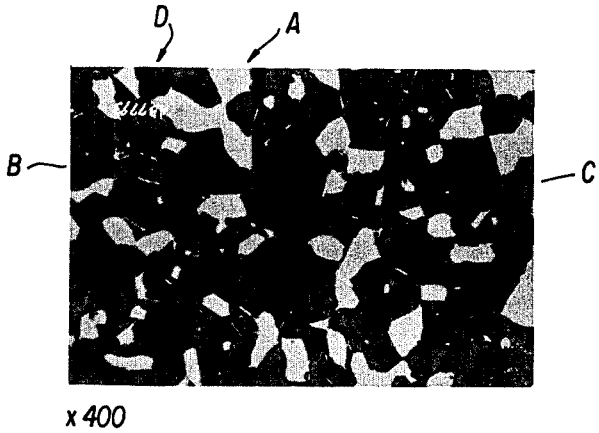
FIG. 1 is a micrograph (X400) showing the microstructure of an anti-wear sintered alloy according to the present invention.

The anti-wear sintered alloy according to the present invention is characterized by high durability as well as high density and high hardness. The sintered alloy contains in percent by weight: Cr, about 2.5—about 7.5%, preferably about 4.5—about 6.5%, more preferably about 4.5—6.0%; Mn, about 0.1—about 3.0%, preferably up to about 1.5%, more preferably up to about 1.2%; P, about 0.2—about 0.8%, preferably about 0.35—about 0.65%, more preferably about 0.40—about 0.60%; Cu, about 1.0—about 5.0%, preferably about 1.5–3.0%, more preferably up to about 2.5%; Si, usually about 0.5—about 2.0%, preferably about 0.7—about 1.5%, more particularly up to about 1.3%; Mo, usually less than about 3%, preferably about 0.5—about 1.5%, more preferably about 0.7—about 1.3% Co, about 1.5—about 3.5%, preferably about 1.8—about 3.0%, more preferably about 2.0—about 2.8%, and less than 2% impurities, the balance being Fe. Preferably the Fe is about 90—about 85%.

The sintered alloy according to the present invention is further characterized by a density of about 7.3–7.8 g/cm$^3$, preferably about 7.4—7.8 g/cm$^3$; and apparent hardness Hv (10 kg) of 350–800, preferably 400–700, more preferably 400–600; and a uniform distribution in the matrix of mainly $M_3C$ carbides of mean particle size about 5–30 microns, preferably 10–25 microns, and/or a hardened steadite phase such that they constitute about 5 to about 30%, preferably about 15 to about 20% of the matrix area, the microhardness HV (200 g) of said carbide particles being 800–1300.

The sintered alloy according to the present invention can be obtained by preparing an alloy powder containing the elements except carbon; adding a specific amount of carbon to this powder followed by mixing, compacting and sintering.

The alloy powder, which constitutes the material of the sintered alloy according to the present invention, can be obtained by routine processes. It is usually obtained from a molten metal by the atomizing method.

According to the atomizing method, the molten alloy prepared by mixing the components of the alloy powder, then atomized by a jet water stream in an $N_2$ atmosphere. The particle size of the atomized alloy powder is almost less than 80 mesh, preferably less than 100 mesh.

The material for the alloy powder should desirably contain as impurities: oxygen less than 0.5%, preferably less than 0.3% and carbon less than 0.3%, preferably less than 0.1%.

The atomized alloy powder thus obtained is mixed with carbon, usually graphite, preferably scaly graphite. Usually graphite of up to about 10$\mu$ in mean particle diameter is employed, but fine particles of less than 2–3$\mu$ would be preferable. These elements may be blended by routine procedures. A mother mixing method, such as a depressurized blending method or a vibration-mill method can also be adopted. These methods will minimize the segregation of graphite in the blending and compacting processes, thereby making the matrix hardness, shape, size and distribution of carbides in different parts of the product uniform and giving desirable results with less variance in the anti-wear, anti-scuffing and anti-pitting properties of the product.

The conventional lubricant like zinc stearate may be added and mixed for compaction. The amount of the lubricant to be added is less than about 1.2%, preferably about 0.3–1.0%.

The material thus prepared is compacted and sintered. The compaction is done to a desired shape usually under a pressure of about 5 to about 7 t/cm$^2$, preferably about 6—about 7 t/cm$^2$. The densities of the compacts are passably about 5.8 to about 6.4 g/cm$^3$, preferably about 5.9—about 6.3 g/cm$^3$. The compressed powder is next sintered at a temperature in the range of about 1020° C. to about 1180° C., preferably about 1050° C. to about 1150° C. The sintering time depends on the temperature. The sintering is performed usually for about 30 to about 90 minutes. It is desirable that the sintering be carried out in innert or reducing gases such as hydrogen, nitrogen, hydrogen-nitrogen mixure, or decomposed ammonia, or under vacuum. It is undesirable that the sintering be carried out in the common RX denatured gas. The dew point of the atmosphere used is desirably less than −10° C., more desirably less than −20° C.

The sintered part thus obtained acquires the necessary hardness through cooling from about 750° C. to about 450° C. at a rate of about 10° C./min, preferably 20°–100° C./min.

Using the sintered alloy thus obtained, engine cams and other parts can advantageously be coupled. For example, an engine cam of this sintered alloy may be diffusion-bonded with a steel shaft during sintering, thus producing a cam-shaft. In working and assembling the sintered parts, it is possible to presinter the compacts, which is usually done at 900°–1000° C.

The machine parts fabricated form the sintered alloy according to the present invention exhibit excellent durability and wear resistance as slidable parts. They permit formation of a stable lubricant film thereon, and they can be simply and cheaply produced.

Each element contained in the sintered alloy of the present invention imparts a desirable effect.

Part of the chrome is solid-solved in the matrix and strengthens the matrix by forming martensite or a bainite in the cooling process following the sintering. The balance of the chrome combines with carbon to form hardened carbide particles of the mainly $M_3C$ type with $(Fe{\cdot}Cr)_3C$ as the main component, thereby enhancing the anti-wear, anti-scuffing and anti-seizure properties of the sintered alloy.

The addition of too little chrome is undesirable because it will result in the insufficient formation of carbide and the concentration of a carbide-like network on the crystalline boundary, thereby coarsening the structure and vastly decreasing the slidability. The addition of too much chrome is equally undesirable because it results in an excess of carbide after sintering, a change of crystal structure from $M_3C$ type to $M_7C_3$ type and the virtual disappearance of the phosphorus containing phase of steadite, thereby decreasing slidability by increasing galling of the alloy on the piece to be coupled.

The effect of Mn addition on the activation of the Fe matrix for sintering is found optimum when Cr is present in the range of 2.5–7.5 wt. %.

When the liquid phase generated in the sintering process of the alloy according to the present invention is utilized to join the alloy to another piece of, say, steel, an amount of chrome exceeding the upper limit in the alloy will result in an insufficiency of the liquid phase, thereby lowering the joint strength.

If the amount of chrome is increased, the machinability will decline, and the applicability of a lubrite layer to improve the initial fit will become poor, causing thereby an increase in cost. Thus, the chrome addition is limited to 2.5–7.5%. The optimum range is 4.5–6.5%.

Manganese plays a highly significant role in the present invention with the following three effects. First, it is solid-solved in the matrix and strengthens the matrix and remarkably improves the hardenability of the alloy when it hardens in a slow-cooling process of 10° C./min in a continuous sintering furnace of decomposed ammonia gas. The alloy easily attains an apparent Hv (10 kg) of over 350, thereby improving slidability.

Second, Mn activates the Fe matrix for sintering, thereby enabling sintering at lower temperatures, resulting in a saving of energy. As mentioned above, the effect is optimum when the presence of Cr is in a range of 2.5–7.5%.

Third, Mn inhibits crystal growth, refined the carbide and contributes to spheroidization, thereby improving slidability.

There is virtually no enhancement of the strength of a preliminary sintered mass when less than 0.10% by wt. of Mn is added. More than 3.0% Mn, on the other hand, will spheroidize and harden the atomized alloy powder. This hardening causes not only a significant loss of compactibility of the powder, which makes it impossible to obtain the desired density or hardness, but also an increase in residual austenite in the matrix and a lowering of sinterability through oxidization. Thus the addition of Mn is limited to 0.10–3.0%, preferably 0.10–1.5%.

Phosphorus contributes to the sintered alloy of the present invention in that it is solid-solved into the matrix during sintering and activates the sintering. Thus, the sintering can be conducted at lower temperatures and gives a higher density by forming a liquid phase of a low melting-point steadite. This effect of phosphorus will, however, be unsatisfactory when less than a minimum amount is added to the alloy.

On the other hand, if too much P is added, the liquid phase becomes excessive, resulting in abnormal growth of carbide and steadite and embrittlement of the crystalline boundary, resulting in a decrease in slidability. Thus the addition of phosphorus is limited to 0.2–0.8%, preferably 0.35–0.65%.

Copper is solid-solved in the matrix, stabilizes the sintering, increases the strength and hardenss of the matrix, refines the carbide and contributes to a spherodization of the latter. When too little copper is added, these effects will not be significant; when too much is added, the crystalline boundary will be weakened, resulting not only in lowered slidability, but also in an increase in cost. Thus, the addition is limited to 1.0–5.0%, preferably 1.5–3.0%.

Silicon is solid-solved in the matrix and stabilizes the sintering of the Fe matrix. Particularly in the presence of about 2.5–7.5% chrome, it is effective for preventing variations in density or hardness due to variations in carbon content. Silicon is also effective for spheroidization of carbide particles. Meanwhile, silicon is necessary as an essential deoxidizer of the molten metal when it is atomized to make an alloy powder.

Insufficient amounts of silicon cause an increase in the oxidization of the powder. Too much silicon not only lowers the hardenability of the matrix, resulting in a loss of hardness, but also coarsens the carbide and causes its segregation on the crystalline boundary, resulting in a lowering of slidability. Thus the addition of silicon is limited to 0.5–2%, preferably 0.7–1.5%.

Graphite which is added as a source of carbon is solid-solved in the matrix and increases the hardness and strength of the matrix. Moreover, graphite improves wear resistance by forming, together with chrome and molybdenum, such compound carbides as $(Fe \cdot Cr)_3C$ or $(Fe \cdot Cr \cdot Mo)_3C$ and by contributing to the formation of steadite phase ($Fe-Fe_3C-Fe_3P$).

Insufficient graphite, however, causes a decrease in the hardness of the matrix and in the volume of carbide and steadite, while too much graphite causes a coarsening of the structure and a network growth at the crystalline boundary, thereby substantially lowering slidability and causing galling of the coupled piece. Thus, the addition of graphite is limited to 1.5–4.0%, preferably 1.8–3.0%.

Molybdenum, like chrome, not only increases the hardness of the sintered parts by strengthening the matrix and enhancing its hardenability but also improves slidability by forming a hardened compound carbide with $(Fe \cdot Cr \cdot Mo)_3C$ as the main component. Even without the addition of Mo, adequate performance of slidable parts, such as a cam, may be obtained. The addition of less than about 3% by wt. of Mo is nevertheless useful, because it causes the carbide to be more spheroidal and suppresses the galling on the coupled piece. The addition is limited to less than 3%, preferably 0.5–1.5%, because addition exceeding 3% would cause a network formation of carbide at the crystalline boundary, thereby embrittling the alloy, lowering slidability and leading to an increase in cost.

Having generally described the invention, a more complete understanding can be obtained by reference to certain specific examples, which are provided herein for purposes of illustration only and are not intended to be limiting unless otherwise specified.

EXAMPLE 1

Atomized alloy metal powder of −100 mesh was prepared, containing chrome 2.5%, manganese 0.10%, copper 5.0%, silicon 0.5%, phosphorus 0.7%, the balance being Fe and less than 2% impurities. The powder was added with 1.6% scaly graphite as well as zinc stearate 0.5%.

The mixture was submitted to 30 minutes of treatment in a V-type powder mixer. The mixed powder obtained was compacted to a density 6.1 g/cm$^3$ under a compacting pressure 6 t/cm$^2$; sintered for 60 minutes at 1150° C. in a decomposed ammonia gas of a dew point −20° C.; and cooled at about 10° C./min, thereby yielding a sintered alloy according to the present invention. The carbon content of the alloy after sintering dropped to 1.5%.

EXAMPLE 2

Atomized alloy metal powder of −100 mesh was prepared, containing chrome 5.0%, manganese 1.0%, copper 2.0%, silicon 1.0%, and phosphorus 0.5%, the balance being Fe and less than 2% impurities. The powder was added with 2.7% scaly graphite. By the same process as in Example 1, the powder was compacted and sintered at 1120° C., yielding an alloy according to the present invention. The carbon content of the alloy after sintering dropped to 2.5%.

EXAMPLE 3

Atomized alloy metal powder of −100 mesh was prepared, containing chrome 7.5%, manganese 3.0%, copper 1.0%, silicon 2.0%, and phosphorus 0.2%, the balance being Fe and less than 2% impurities. Scaly graphite, 3.8%, was added and the same process as in Example 1. The compressed powder obtained was sintered at 1100° C., yielding an alloy according to the present invention.

The carbon content of the alloy after sintering dropped to 3.5%.

EXAMPLE 4

The alloy powder of Example 2 was added with Mo 3%, yielding an atomized alloy metal powder. The alloy metal powder was submitted to the same treatment as in Example 2, thus yielding an alloy according to the present invention.

Comparison 1

To confirm the effect of Mn, a control was obtained for comparison by manufacturing under the same conditions as in Example 1 an alloy with the composition of Example 1 minus the manganese.

Comparison 2

To confirm the effect of copper, a control was obtained for comparison by manufacturing under the same conditions as in Example 1 an alloy with the composition of Example 1 minus the copper.

Comparison 3

To confirm the effect of silicon, a control was obtained for comparison by manufacturing under the same conditions as in Example 1 an alloy with the composition of Example 1 minus the silicon.

Comparison 4

To confirm the effect of phosphorus, a control was obtained for comparison by manufacturing under the same conditions as in Example 1 an alloy with the composition of Example 1 minus the phosphorus.

Comparison 5

Atomized alloy metal powder of −100 mesh was prepared, containing chrome 20%, copper 2.0%, silicon 1.0% and phosphorus 0.5%, the balance being Fe and less than 2% impurities. The powder was submitted to the same mixing, molding and 60 minutes of sintering at 1150° C. in a decomposed ammonia gas as in Example 2, thereby yielding a control for comparison.

Comparison 6

To prove the necessity for using an atomized alloy metal powder as the mateial, a control was obtained for comparison by concocting iron powder, ferrochrome powder, ferromanganese powder, electrolytic copper powder, ferrosilicon powder and scaly graphite powder to produce the same composition as in Example 1, further adding zinc stearate as the lubricant and then applying the same treatment as in Example 1.

Comparison 7

A control for comparison was obtained by chill-hardening a casting with the composition; carbon 3.2%, silicon 2.1%, manganese 0.7%, chrome 0.5% and molybdenum 0.2%, the balance being Fe and some impurities.

Engine cams made of sintered alloys obtained in the above-mentioned examples, which were diffusion-bonded with shafts through sintering, while above mentioned examples, which were spot-welded with shafts after sintering, were submitted to 1000 hours of motoring test at 1000 rpm in combination with rocker-arms made of JIS (Japan Industrial Standard) SCr 30 cementation-hardened steel, the results being summarized in Table 1. Meanwhile, the properties of the tested materials, i.e. density, hardness, particle size and area ratio of carbide were investigated, the results being summarized also in Table 1.

In Comparison 6, each alloying element was added in the form of a ferro alloy powder to the iron as atomized, copper powder and graphite powder. The mixture was sintered for 60 minutes at 1120° C. in the same way as in Example 1. In Comparison 6, it took longer for each alloying element to diffuse into the matrix than in the case of the alloy powder according to the present invention. The hardness and density of the sintered alloy

TABLE 1

| | Characteristic Values of Sintered Parts | | Carbide Particles | | Wear Test Results | | |
|---|---|---|---|---|---|---|---|
| | Density g/cm³ | Apparent Hardness Hv(10 kg) | Mean Size μ | Area Ratio* % | Cam Wear** μ | Opposite Rocker Arm Wear*** μ | Remarks |
| Example | | | | | | | |
| 1 | 7.36 | 370 | 22 | 16 | 95 | 20 | 2.5Cr—0.10Mn—5Cu—0.5Si—0.7P—1.5C |
| 2 | 7.45 | 560 | 12 | 18 | 22 | 3 | 5.0Cr—1.0Mn—2Cu—1Si—0.5P—2.5C |
| 3 | 7.62 | 780 | 23 | 23 | 25 | 8 | 7.5Cr—1.0Mn—1Cu—2.0Si—0.2P—3.5C |
| 4 | 7.63 | 660 | 18 | 22 | 19 | 2 | Example 2 + 3Mo |
| Comparison | | | | | | | |
| 1 | 6.95 | 300 | 25 | 13 | 260 | 30 | Example 1 minus Mn |
| 2 | 7.32 | 280 | 24 | 15 | 150 | 26 | Example 1 minus Cu |
| 3 | 7.10 | 310 | 20 | 14 | 130 | 25 | Example 1 minus Si |
| 4 | 6.54 | 240 | 3 | 5 | 970 | 110 | Example 1 minus P |
| 5 | 7.51 | 550 | 20 | 35 | 30 | 25 | 20Cr—2Cu—1Si—0.5P—2.5C (with no $M_3C$ carbide and steadite) |
| 6 | 6.98 | 280 | 28 | 12 | 690 | 83 | Example 1 by concoction method |
| 7 | — | 530 | — | — | 320 | 70 | Chilled alloy casting |

Figure 2:
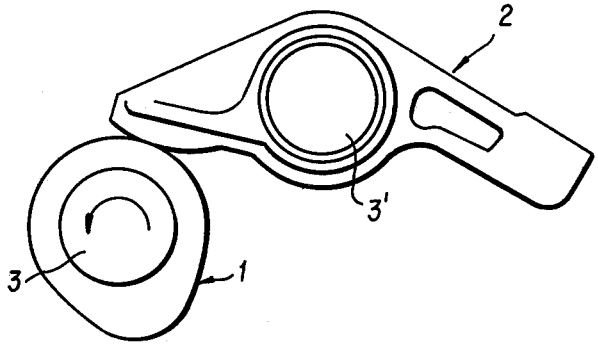
FIG. 2 is a diagram illustrating the durability testing procedure of an anti-wear sintered alloy according to the present invention.

*The ratio of the carbide area to the total area calculated by QTM analyzers or observed by eye from the micrograph
**Wear in cam nose direction
*Maximum worn depth of rocker arm pad In the durability test of motoring, as illustrated in FIG. 2, the cam 1 was put in contact with the rocker-arm 2 and this assembly was applied with an adequately adjusted valve spring load using a low-viscosity oil under certain accelerating conditions. In the figure, 3 and 3'** represent the shafts.

An example of a micrograph (×400) of a sintered alloy obtained in Example 2 according to the present invention is shown in FIG. 1. The particles with the white appearance are $(Fe.Cr)_3C$ carbide A and steadite B (ternary eutectic Fe—$Fe_3P$—$Fe_3C$), the matrix C being a bainite and the symbol D denoting a pore.

The hardness of the carbide in this alloy is Hv 800-1300 and that of the matrix, 400–500.

The durability test (wear test) was done under a pressure of 70 kg/mm² instead of 60 kg/mm², which is a typical pressure exerted by the rocker-arm 2 on the opposite cam 1.

From the above test results it can be seen that whereas the density of an alloy sintered at 1120° C. with the composition of Example 1 is 7.36 g/cm³, that of the alloy of comparison 1 having no manganese is only 6.95 g/cm³. A high-temperature sintering of over 1150° C. would be needed to increase the density of comparison 1.

As pointed out earlier, when the chrome content is 2.5–7.5%, the steadite phase also contributes to improving wear resistance. When the chrome content exceeds 7.5%, there is no contribution to the wear resistance with a virtual disappearance of the steadite phase.

When sintering is conducted at 1120° C., the density of the alloy in Example 1 is 7.36 g/cm³, but that of the alloy in Comparison 4 with no phosphorus is only 6.54 g/cm³. To increase the alloy density of Comparison 4, sintering must be conducted at over 1200° C.

The necessity for using alloying elements other than carbon as a powder of iron alloy will now be explained. obtained were low. Therefore, the alloy had to be sintered at over 1150° C. to increase its hardness and density. Moreover, particle-to-particle sintering was hindered through oxidization of chrome, manganese and silicon, and unless sintering took place in an atmosphere of higher purity and lower dew point, the hardness and density could not be raised. Unlike the alloy powders, each alloying element segregated in the sintered alloy rendering the structure uneven, locally coarsening the carbide particles and making their distribution non-uniform. These are all detrimental to anti-wear, anti-scuffing and anti-pitting properties.

In the alloy according to the present invention, the performance of the alloy is largely affected by the shape, size and distribution of hardened compound carbides. Sharply angular or elongated shapes are less favorable than near-spheroidal ones. As for the size and distribution, the mean particle size distinguishable under an optical microscope (×400) is desirably about 5–30μ, more desirably 10–25μ, while the area ratio is desirably about 5–30%, more desirably 15–20%. A distribution as even as possible is desirable. The microhardness of the carbide particles is desirably Hv (200 g) 800–1300.

In the case of parts, such as a cam, which are to be used under a relatively high plane pressure, the pores in a sintered alloy cannot be expected to help in the formation of an oil film by retaining the lubricant, as is the case in the conventional sintered bearings. On the contrary, the pores are likely to cause pitting. Thus as few pores as possible are desirable and the higher density the better. The density of the alloy of this invention is desirably 7.3–7.8 g/cm³, more desirably 7.4–7.8 g/cm³. Closed pores, that is pores that do not penetrate into the depth of the alloy, are desirable. Furthermore, they are desirably as round as possible, fine and uniformly distributed.

When the hardness of the sintered alloy is too low, the anti-wear, anti-scuffing properties decline; but when it is too high, the alloy causes galling of the opposite piece and a decrease in machinability. Thus, the apparent hardness must be Hv(10 kg) 350–800, desirably 400–600.

In the above, the excellence of the invented alloy in slidable parts such as cams subjected to a relatively high plane pressure has been demonstrated. The invented alloy has been shown to exhibit equally high durability in slidable part such as in journal bearings to be used under an ordinary fluid lubrication. In this case, satisfactory results are obtained with Hv 350–450. As described above, the present invention is a superior high-density, high-hardness, anti-wear sintered alloy produced easily with no need for post-treatments such as forging or any heat treatment.

Having now fully described the invention, it will be apparent to one of ordinary skill in the art that many changes and modifications can be made thereto without departing from the spirit or scope of the invention as set forth herein.

What is claimed is:

1. An anti-wear sintered alloy consisting essentially of chromium 2.5–7.5 weight %, manganese 0.10–3.0 weight %, phosphorus 0.2–0.8 weight %, copper 1.0–5.0 weight %, silicon 0.5–2.0 weight %, molybdenum 0–3 weight %, and carbon 1.5–3.5 weight %, the balance being Fe and less than 2% impurities.

2. An anti-wear sintered alloy according to claim 1, wherein chromium is 4.5–6.5 weight %, manganese 0.10–1.5 weight %, phosphorus 0.35–0.65 weight %, copper 1.5–3.0 weight %, silicon 0.7%–1.5 weight %, molybdenum 0.5–1.5 weight %, and carbon 1.8–3.0 weight %, the balance being Fe and less than 2% impurities.

3. The anti-wear sintered alloy of claim 1, wherein chromium is 4.5–6.0 weight %, manganese 0.10–1.2 weight %, phosphorus 0.40–0.60 weight %, copper 1.5–2.5 weight %, silicon 0.7–1.3 weight %, molybdenum 0.7–1.3 weight %, and carbon 2.0–2.8 weight %, the balance being Fe and less than 2% impurities.

4. The alloy of claim 1, 2 or 3, wherein the apparent hardness is Hv (10 kg) 350–800.

5. The alloy of claim 1, 2 or 3, wherein the apparent hardness is Hv (10 kg) 400–600.

6. The alloy of claim 1, 2 or 3, having particles of a hardened phase of $M_3C$ carbide and steadite uniformly distributed in a matrix, wherein the mean size of said particles is 5–30$\mu$.

7. The alloy of claim 6 wherein the mean size of said particles is 10–25$\mu$.

8. The alloy of claim 1, 2 or 3, having particles of a hardened phase of $M_3C$ carbide and steadite uniformly distributed in a matrix, the area ratio of particles being 5–30% of the matrix.

9. The alloy of claim 1, 2 or 3, having particles of a hardened phase of $M_3C$ carbide and steadite uniformly distributed in a matrix, the area ratio of particles being 15–20% of the matrix.

10. Alloy of claim 1, 2 or 3, wherein the density is 7.3–7.8 g/cm$^3$.

11. The alloy of claim 1, 2 or 3, wherein the density is 7.4–7.8/cm$^3$.

12. A sintered alloy with less than 2% impurities prepared by a process comprising preparing an alloy powder consisting essentially of Cr 2.5–7.5 weight %, Mn 0.10–3.0 weight %, P 0.2–0.8 weight %, Cu 1.0–5.0 weight %, Si 0.5–2.0 weight %, Mo 0–3 weight % and Fe 75.2–89.7% with less than 2% impurities by an atomizing method; blending the alloy powder thus obtained with graphite powder 1.5–3.5% and a lubricant 0–1.2% to form a mixture; compacting the mixture to a density 5.8–6.4 g/cm$^3$ under a pressure 5–7 t/cm$^2$; sintering the compacts at 1020°–1180° C. and then cooling at 10°–100° C./min.

* * * * *